US005291693A

United States Patent [19]

Nguyen

[11] Patent Number: 5,291,693

[45] Date of Patent: Mar. 8, 1994

[54] SEMICONDUCTORS STRUCTURE PRECISION LAPPING METHOD AND SYSTEM

[75] Inventor: Jane H. Nguyen, Fort Bend, Tex.

[73] Assignee: Texas Instruments Incorporated, Dallas, Tex.

[21] Appl. No.: 932,810

[22] Filed: Aug. 20, 1992

[51] Int. Cl.[5] ..... B24B 53/02

[52] U.S. Cl. ..... 51/283 R; 51/262 A; 51/325

[58] Field of Search ..... 51/266, 263, 125, 262 A, 51/325, 283 R

[56] References Cited

U.S. PATENT DOCUMENTS

| | | | |
|---|---|---|---|
| 2,568,096 | 9/1951 | Stewart | 51/266 |
| 3,812,622 | 5/1974 | Parsons | 51/266 |
| 3,982,605 | 9/1976 | Sneckenberger | 51/439 |
| 4,525,955 | 7/1985 | Cothrell et al. | 51/262 A |
| 4,625,460 | 12/1986 | Burgess et al. | 51/125 |
| 5,154,021 | 10/1992 | Bombardier et al | 51/325 |

OTHER PUBLICATIONS

Precision VLSI Cross Sectioning and Staining; Mills et al; IEEE/Proc. IRPS; © 1982 (pp. 214–223).

*Primary Examiner*—Robert A. Rose

*Attorney, Agent, or Firm*—Lawrence J. Bassuk; Rose K. Castro; Richard L. Donaldson

[57] ABSTRACT

An apparatus in the form an $N_2$ gas gun (30) improves the lapping of a semiconductor device (22) by lapping equipment (10) by an associating a predetermined location (32) on the lapping surface (20) with the semiconductor device (22). Compressed $N_2$ gas flows through a nozzle device (30) to the predetermined location (32) on the lapping surface (20). Nozzle holder (28) holds the $N_2$ gas gun (30) in a position for the compressed gas to blow particulate from predetermined location (32) prior to the predetermined location (32) associating with the semiconductor device (22).

12 Claims, 2 Drawing Sheets

SEMICONDUCTORS STRUCTURE PRECISION LAPPING METHOD AND SYSTEM

TECHNICAL FIELD OF THE INVENTION

The present invention relates to semiconductor devices and more particularly to an improved semiconductor device precision lapping method and system that promotes faster and more accurate analysis of semiconductor structures.

BACKGROUND OF THE INVENTION

The continued scaling down of semiconductor devices features and thin films makes the high resolution scanning electron microscope (SEM) a necessary analytical tool for examining surface structures and interfaces. The SEM makes it possible to view much smaller areas on semiconductor devices than is possible with other types of microscopes or viewing equipment. To see many of these areas, it is necessary to cut or slice sample semiconductor devices. As devices are cut using known techniques, however, damage to the semiconductor device may occur. As microstructures continue to gain importance in the semiconductor industry, the adverse effects of manual cleaving or cutting to obtain SEM specimens become even more pronounced. Since more and more circuits are using these sub-micron devices, the utility of manual cleaving procedures has diminished significantly.

In today's semiconductor industry, minimizing process time and improving product quality are dominant obsessions. For example, a primary goal for failure analysis laboratories is rapid and accurate analysis of component failures to find the root cause of process problems. Most notable among improved failure analysis equipments is a lapping equipment, such as that for accomplishing the technique detailed in T. Mills & E. W. Sonheimer, "Precision VLSI Cross-Sectioning and Staining," 1982 Int'l Reliability Phys. Symp., 20th Ann'l Proc., pp. 214–220, IEEE, New York, N.Y., and B. R. Hammond & T. R. Vogel, "Non-Encapsulated Microsectioning as a Construction and Failure Analysis Technique," 1982 Int'l. Reliability Phys. Symp. 20th Ann'l Proc., pp. 221–223, IEEE, New York, N.Y. This lapping equipment delicately grinds the semiconductor device using a diamond wheel similar to that used to cut or polish glass and jewels. Using a precision lapping tool enables cross-sectioning at a ±0.2 micron scale with a 90% competence level of the depth and location of lapping.

The precision lapping technique places the SEM specimen in contact with a rotating diamond wheel under running water (DI or city water) at a speed of approximately 200 rpm. Using this improved lapping technique, however, damage to the semiconductor devices may still occur. For example, often it has been shown that deformation and scratches of the semiconductor device may occur from the lapping procedure. Deformation and scratches are principally due to particulates chipping away from the semiconductor device and adhering to the polishing surface. These particulates rotate back with the lapping wheel to cause damage to the semiconductor device itself. The complications of deformations and scratches slow the failure analysis process by causing the process to take longer and be less accurate.

Fine polishing of the semiconductor specimens in the lapping equipment can also cause particulate to build up at an edge of the semiconductor specimen as a result of the rotating lapping wheel carrying with it particulate that is polished or chipped away from the semiconductor device. This buildup makes it difficult to precisely cross-section the semiconductor devices at desired locations. This is due to crushed materials that accumulate on the front side of the lap specimen. These crushed materials get in the way of the lapping wheel surface and significantly affect cutting the SEM specimen.

There is a need, therefore, for an improved semiconductor device precision lapping technique that avoids the deformation and scratches associated with known cleaning and lapping techniques.

There is a need for a method and system for semiconductor structure precision lapping that permit precise cross-sectioning of the semiconductor structure at required locations and avoid the accumulation of crushed materials over the front side of the lapped specimen.

Further, there is a need for a semiconductor structure lapping method and apparatus that permit more rapid and effective lapping of semiconductor devices and overcome the need to continually rework and relap semiconductor devices during SEM analysis.

SUMMARY OF THE INVENTION

The present invention, accordingly, provides an improved semiconductor device precision lapping method and system that overcome or reduce disadvantages and limitations associated with prior precision lapping and cutting techniques and systems.

One aspect of the invention is a method for removing particulate from a lapping surface during a semiconductor device lapping process that includes, a step of continuously directing controlled pressurized gas to the same area of the lapping surface that contacts the semiconductor device. The controlled pressurized gas removes the particulate from the area prior to the area lapping the semiconductor device.

Another aspect of the invention is an apparatus that improves the semiconductor device lapping by using a lapping surface that associates a predetermined location on the lapping surface with the semiconductor device. The apparatus includes a compressed gas device that delivers compressed gas to the predetermined location on a lapping surface. A nozzle holder holds the nozzle device in a position so that the compressed gas blows particulate from the predetermined location prior to the predetermined location associating or lapping the semiconductor device. Other novel aspects of the invention include the use of a nozzle muffler to minimize flow noise associated with the compressed gas as well as variable flow control device to ensure the highest possible quality of particulate removal.

A technical advantage of the present invention is that it permits precision lapping of semiconductor devices with minimum deformation and minimum scratches. By removing the particulate from the predetermined locations on the lapping surface, the present invention prohibits the crushed materials that chip away from the semiconductor device from rotating around the lapping wheel and contacting the device itself.

Another technical advantage of the present invention is that it permits faster cross-sectioning of semiconductor devices for SEM scanning. By eliminating the deformation and scratches that the conventional processes cause, the present invention avoids the need to rework and relap particular sections of the SEM sample. This promotes faster SEM analysis of the semiconductor device.

Yet another technical advantage of the present invention is that it permits more accurate cross-sectioning of the SEM sample by eliminating the build-up or accumulation of crushed materials over the front side of the lapped semiconductor device specimen. As a result, it is possible to precisely identify particular points for analysis on the SEM sample without the risk that these samples may be deformed or scratched during the lapping process.

BRIEF DESCRIPTION OF THE DRAWINGS

The invention and its modes of use and advantages are best understood by reference to the following description of illustrative embodiments when read in conjunction with the accompanying drawings, wherein.

DETAILED DESCRIPTION OF THE INVENTION

The preferred embodiment of the present invention is best understood by referring to the FIGURES wherein like numerals are used for like and corresponding parts of the various drawings.

The approach of the present invention is to precisely cross-section semiconductor materials using a process that yields minimum deformation and scratches in the microstructures. The deformation and scratches that can occur are often observed from known techniques using a diamond lapping wheel under running water. The preferred embodiment uses a pressurized nitrogen flow installed at a 40°–45° angle to the vertical axis of the lapped wheel surface. This creates an additional force that is strong enough to lift gross particulates from the lapping surface prior to their going back to impact and damage semiconductor structure. This prevents deformation and scratches to the microstructures. The preferred embodiment, as a result, provides a needed and useful tool for analysts to use in the analysis of complex VLSI devices that use sub-micron semiconductor devices.

Figure 1:
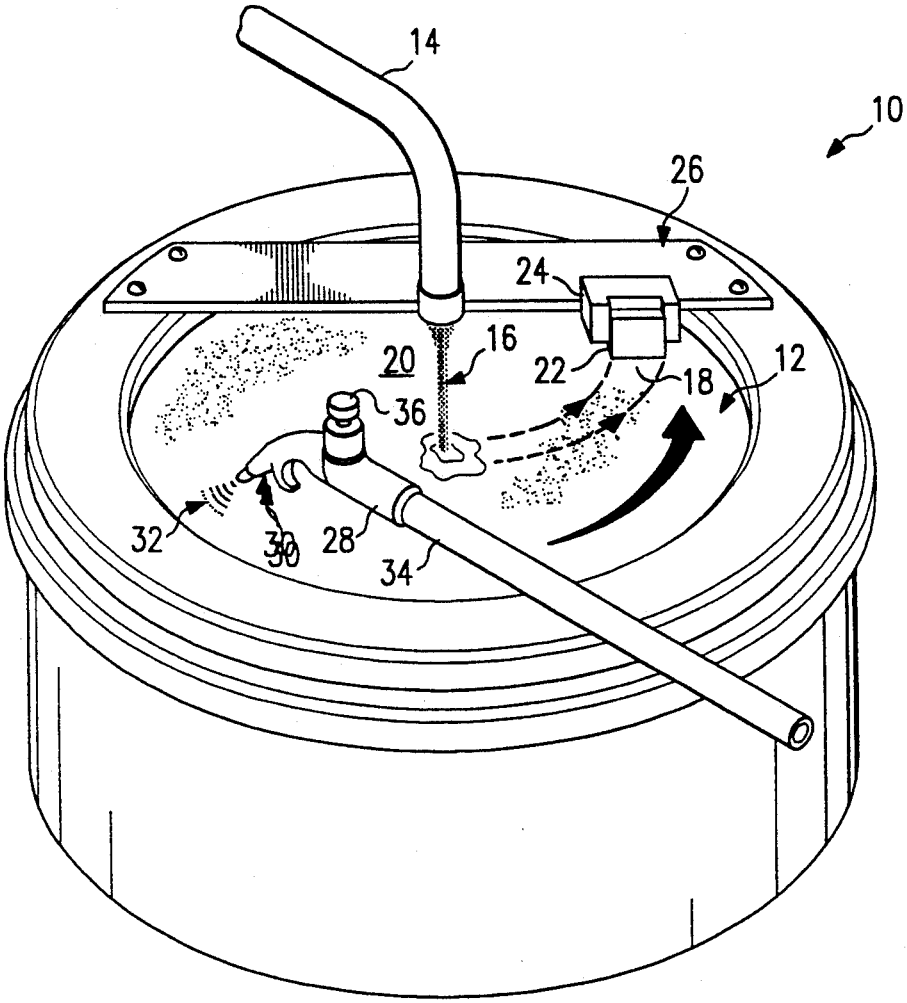
FIG. 1 provides an isometric view of a precision lapping equipment that employs the preferred embodiment of the present invention.

Referring to FIG. 1, there is shown an isometric view of lapping equipment 10 having lapping wheel 12 that rotates in a counterclockwise direction. Water tap 14 provides water 16 to flow to a predetermined position 18 of lapping wheel 12. Water 16 lubricates surface 20 that laps semiconductor device 22 as lapping wheel 12 rotates. Device mount restraining bar 26 holds semiconductor device 22 in a stationary position relative to rotating lapping wheel 12. Mounting bar 28 holds $N_2$ gas gun 30 in place so that a flow of $N_2$ gas goes to predetermined position 32 on lapping wheel surface 20. Connecting to $N_2$ gas gun 30 is hose 34 that directs compressed $N_2$ gas to $N_2$ gun 30. For control of the flow speed of $N_2$ gas through tapered gun 30, adjustable control stem 36 is included.

$N_2$ gas gun 30 directs controlled flow at a 40°–45° angle to the vertical axis of lapping wheel surface 20. The preferred embodiment uses $N_2$ gas because that gas can be released in the environment with minimal adverse effects to operators. Other gases that do not interact with semiconductor device 22 or otherwise adversely affect the laboratory environment or operators may be also used. The compressed $N_2$ gas flow creates a force F sufficiently strong to lift particulate from lapping wheel surface 20 prior to the particulate rotating back to and adversely affecting semiconductor device 22. The force F pushes all particulate generated during lapping as well as water 18 streaming out from behind the semiconductor device 22 from lapping wheel 12. The force F is the resultant force from the kinematic relation between rotating lapping wheel 12 and the translational, rotational motion of running water 18 over lapping wheel 12.

Figure 2:
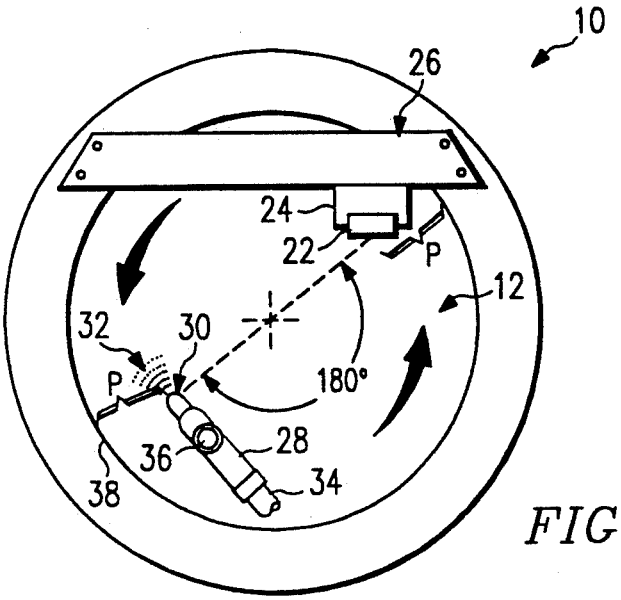
FIG. 2 provides an overhead view of the lapping equipment of FIG. 1 to illustrate a preferred placement of the gas gun of the preferred embodiment relative to the semiconductor device.

FIG. 2 provides a simplified overhead view of lapping wheel 12 that indicates the position of device mount 24 relative to the gas flow at predetermined position 32. Note that the distance P from the outer perimeter of lapping wheel 12 to the semiconductor device 22 is the same distance between predetermined position 32 and outer perimeter 38. Insuring that $N_2$ gas gun 30 and semiconductor device 22 are the same distance P from the lapping wheel 12 perimeter causes the maximum removal of crushed materials or other particulate from where semiconductor device 22 touches lapping wheel surface 20.

Figure 3:
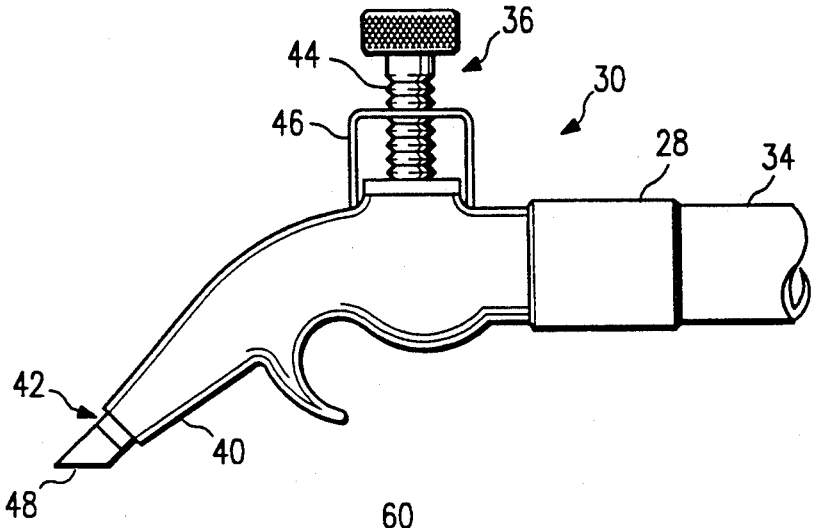
FIG. 3 provides a side external view of the nozzle portion of the preferred embodiment.

FIG. 3 provides a side schematic view of air gun 30 of the preferred embodiment. $N_2$ gas gun 30 includes nozzle portion 40 having nozzle tip 42 and flow control valve assembly 36. Flow control valve assembly 36 provides $N_2$ gas gun 30 with a variable flow control valve to which stem 44 attaches. Stem 44 threads to stem mount 46 to permit variable flow control through $N_2$ gas gun 30. Rubber tubing 48 attaches to nozzle tip 42 and absorbs flow noise that may otherwise adversely affect nearby operators. A particular aspect of rubber tip 48 is that the gas outlet 49 of rubber tip 48 should be cut parallel to lapping surface 20 of lapping wheel 12. By causing gas outlet 49 to be parallel to lapping surface 20, less escape gas hits the outer guard ring resulting in less noise.

The preferred embodiment provides a high-quality lapped specimen with minimum microstructure deformation or scratches using polishing or lapping equipment 10. With a minimum water flow that causes a water layer of approximately 2 to 3 millimeters thickness over lapping surface 20 and with lapping wheel 12 rotating at a speed of between 180 and 220 rpm, the preferred embodiment achieves the improved precision lapping that preserves the integrity of even sub-micron semiconductor devices. The amount of $N_2$ gas flow that a particular application may require can be determined by examining different results of semiconductor device 22 lapping with varying $N_2$ gas flows.

To describe the operation of the invention as a whole, therefore, the preferred embodiment may be employed as follows. Semiconductor device 22 is placed within device mount 24 which rests on restraining bar 26. As lapping wheel 12 rotates in a counterclockwise direction, predetermined location 32 is blown free of any particulate that it may contain by compressed $N_2$ from $N_2$ gas gun 30. As lapping wheel 12 rotates, predetermined position 32 of lapping surface 20 rotates to contact semiconductor device 22. At this point, the predetermined position is clear so that a clean circle of lapping surface 20 always is available to lap semiconductor device 22. During the lapping procedure according to the preferred embodiment, either no or very little particulate or crushed material contacts semiconductor device 22. The result is a significantly improved lapping procedure that yields a more usable SEM semiconductor device specimen.

Figure 4:
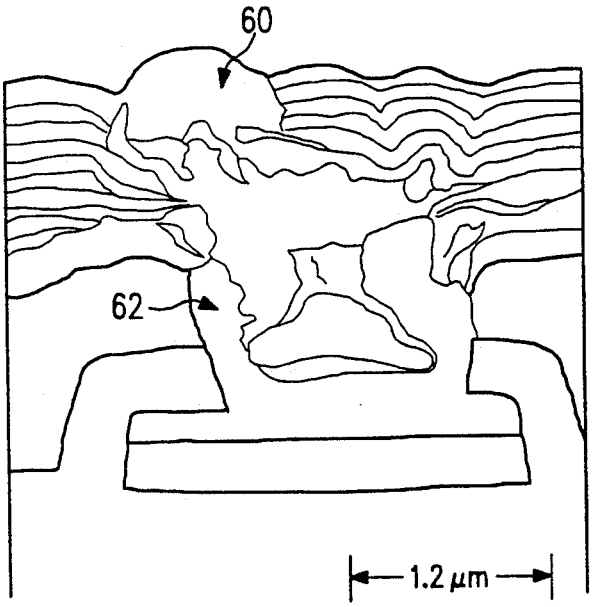
FIGS. 4 and 5 illustrate comparative samples of semiconductor device cross-sections as seen through a scanning electron microscope to illustrate the results from the preferred embodiment.
Figure 5:
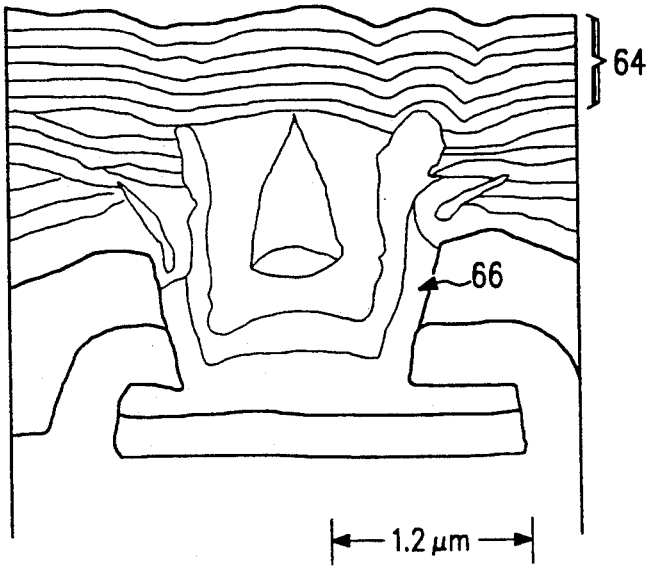

FIGS. 4 and 5, respectively, show drawings taken from photomicrographs of SEM semiconductor device specimens. These drawings illustrate the results of lapping two different SEM semiconductor device specimens, first without the use of the preferred embodiment and then with the preferred embodiment. These are view of the sides of the semiconductor devices. The parameters associated with these SEM photographs are the following. Using an electron beam having a 25K volt potential and a magnification of 25,000X, FIGS. 4 and 5 illustrate a length equivalent to 1.2 μm. At this scale, the results of the preferred embodiment are apparent. In FIG. 4, SEM photomicrograph shows crushed interlevel oxide layers 60 and deformed polygate contact structure 62. FIG. 5, on the other hand, shows undamaged interlevel oxide layers 64 and, very importantly, preserved semiconductor polygate contact structure 66. The SEM photomicrograph of FIG. 5, therefore, illustrates a substantial improvement over the deformed and scratched structure of FIG. 4.

The preferred embodiment, therefore, provides an apparatus that improves the lapping of a semiconductor device by first cleaning predetermined location 32 on lapping surface 20 that compressed $N_2$ gas cleans by flowing $N_2$ gas through nozzle device or gas gun 30 to lift off particulate from the predetermined location 32, and thereby clean locations 32 prior to location 32 contacting semiconductor device 22. This promotes faster SEM analysis procedures, because rework of the SEM specimens is generally no longer required. Additionally, because crushed materials and particulate do not contact and, therefore, do not accumulate on the front side of the SEM specimen, it is possible to more accurately and more precisely cross-section the SEM specimen at specified locations of the semiconductor device.

Although the invention has been described with reference to the above specified embodiments, this description is not meant to be construed in a limiting sense. Various modifications of the disclosed embodiment, as well alternative embodiments of the invention will become apparent to persons skilled in the art upon reference to the above description. It is, therefore, contemplated that the appended claims will cover such modifications that fall within the true scope of the invention.

I claim:

1. A method for removing particulate from a lapping surface during a semiconductor lapping process, comprising the steps of:

rotating said lapping surface around a central axis in one direction;

directing a flow of water to said lapping surface;

continuously directing, opposite the direction of rotation, a controlled pressurized gas to a predetermined area of the lapping surface to remove the particulate from said predetermined area prior to said predetermined area contacting the semiconductor device and:

controlling noise associated with directing said controlled pressurized gas to said predetermined area by directing said controlled pressurized gas through a nozzle then through tubing associated with said nozzle, said tubing having a diameter narrower than said nozzle.

2. The method of claim 1, further comprising the step rotating said lapping surface so that said predetermined area continually establishes a ring on said lapping surface that has removed particulate therefrom.

3. The method of claim 1, wherein said flow noise control step further comprises the step of directing said controlled pressurized gas through tubing which is substantially comprised of rubber.

4. The method of claim 1, wherein said controlled pressurized gas directing step further comprises the step of continuously flowing nitrogen gas to said predetermined area.

5. The method of claim 1, further comprising the step of variably controlling the flow rate of said controlled pressurized gas to said predetermined area.

6. The method of claim 1, wherein said lapping process includes the step of directing water to flow over said lapping surface and wherein said particulate removing step further comprises the step of causing said controlled pressurized gas to push said water off said lapping surface.

7. An apparatus for improving the lapping of a semiconductor device comprising:

a substantially circular diamond lapping surface that associates a predetermined location on the lapping surface with the semiconductor device as the lapping surface rotates in one direction around a central axis;

a water tap for directing a flow of water to said lapping surface;

a compressed gas;

a nozzle device for flowing said compressed gas opposite the direction of rotation;

a nozzle holder for holding said nozzle device in a position for said compressed gas to blow particulate from said predetermined location prior to said predetermined location associating with the semiconductor device and:

a flow noise attenuator associated with said nozzle device to reduce noise associated with said flow of said compressed gas, said flow noise attenuator having a diameter narrower than said nozzle device.

8. The apparatus of claim 7, wherein upon rotating said lapping surface said predetermined location forms a ring of said lapping surface from which said particulate is blown.

9. The apparatus of claim 7, wherein said flow noise attenuator comprises a rubber nozzle associated with said nozzle device.

10. The apparatus of claim 7, wherein said compressed gas comprises compressed nitrogen gas.

11. The apparatus of claim 7, wherein said nozzle device further comprises a variable compressed gas flow device for variably controlling the flow of said compressed gas.

12. The apparatus of claim 7, wherein said water tap directs said water flow to a predetermined position on said lapping surface and wherein said compressed flow further comprises sufficient pressure associated with said flow to remove particulate in suspension with said water.

* * * * *